United States Patent [19]

Shenker

[11] 3,994,443

[45] Nov. 30, 1976

[54] CLEANING JAWS FOR MINIATURIZED OBJECTS

[76] Inventor: Martin Shenker, 7700 Cindy Lane, Bethesda, Md. 20034

[22] Filed: Feb. 9, 1976

[21] Appl. No.: 656,199

[52] U.S. Cl. ..... 239/545; 239/289; 239/566; 239/567; 239/587; 34/DIG. 13; 34/160; 134/122 P

[51] Int. Cl.² ..... B05B 1/20; B08B 5/02; F26B 13/02

[58] Field of Search ..... 239/565–567, 239/289, 543–545, 587, 602; 34/23, 33, 34, 155, 160, DIG. 13; 134/37, 122 R, 122 P, 131, 151; 118/316, 325

[56] References Cited

UNITED STATES PATENTS

| | | | |
|---|---|---|---|
| 1,942,905 | 1/1934 | Semkow | 239/565 X |
| 2,593,295 | 4/1952 | Granfield | 239/587 X |
| 2,775,773 | 1/1957 | Marsh | 239/565 X |
| 3,088,515 | 5/1963 | Fagan | 239/587 X |
| 3,185,397 | 5/1965 | Nelson | 239/567 X |
| 3,214,845 | 11/1965 | Huffman | 34/160 X |
| 3,805,409 | 4/1974 | Sato et al. | 34/160 |
| 3,816,065 | 6/1974 | Marietta | 239/565 X |
| 3,899,137 | 8/1975 | Shenker | 239/545 |

FOREIGN PATENTS OR APPLICATIONS

| | | | |
|---|---|---|---|
| 355,574 | 6/1922 | Germany | 34/155 |
| 182,671 | 7/1936 | Switzerland | 239/565 |
| 20,690 AD | 1899 | United Kingdom | 239/544 |

*Primary Examiner*—Robert S. Ward, Jr.

[57] ABSTRACT

A miniaturized object cleaning apparatus which is portable and adjustable including two juxtaposed concave, allochiral, elongated tubular jaws containing opposed openings for passage of ionized air in the form of jets to remove fine dust particles from said article.

10 Claims, 5 Drawing Figures

CLEANING JAWS FOR MINIATURIZED OBJECTS

This invention is an improvement over applicant's U.S. Pat. No. 3,899,137 filed on Dec. 17, 1974 and issued on Aug. 12, 1975.

This invention relates to photography and is particularly concerned with the removal of ultra fine dust particles from photo slides and film.

Fine dust particles that are less than 50 microns in size are invisible to the naked eye. However, upon enlargement, they will show up as small visible black or white dots which are detrimental to the finished appearance of the picture.

The prior art devices for solving this problem have used opposing cleaning brushes as in Smith U.S. Pat. No. 2,351,371; opposing wiping cloths as in Christianson U.S. Pat. No. 3,644,953; vacuum and brushes as in Gould U.S. Pat. No. 1,926,981; air brushes and flutter as in Troia U.S. Pat. No. 3,470,576; and air jets for cleaning liquid from film as in Capstaff U.S. Pat. No. 2,289,753. However, all of these devices result in increased static electricity which causes the dust particles to cling to the surface of the article being cleaned. In addition, these devices cannot remove dust effectively from the surface and corners of film mounted or held in frames, such as slide mounts or metal film carriers.

All of the prior art patented devices, including applicant's patented device, are to be used in place on a table or machine mount and cannot be held in the hand for being carried to a movable or fixed workpiece. Additionally, they are not adjustable for use on various sizes of objects to be cleaned.

The object of this invention is to provide opposed air jet jaws that are portable and adjustable, and are of light weight so that they can be carried by one hand leaving the other free to pass the work to be cleaned between them.

It is a further object to employ such a design for the opposed air jets as will minimize the Bernoulli effect which tends to draw the slide or film to be cleaned towards one of the air jet surfaces.

It is a further object to so shape the opposed jet containing jaws as to avoid contact between the jaws and the slide or other object being cleaned.

The novel features and advantages of the present invention will become apparent after reading the following description which refers to the accompanying drawing wherein.

Figures 1, 2, 3, 4, 5:
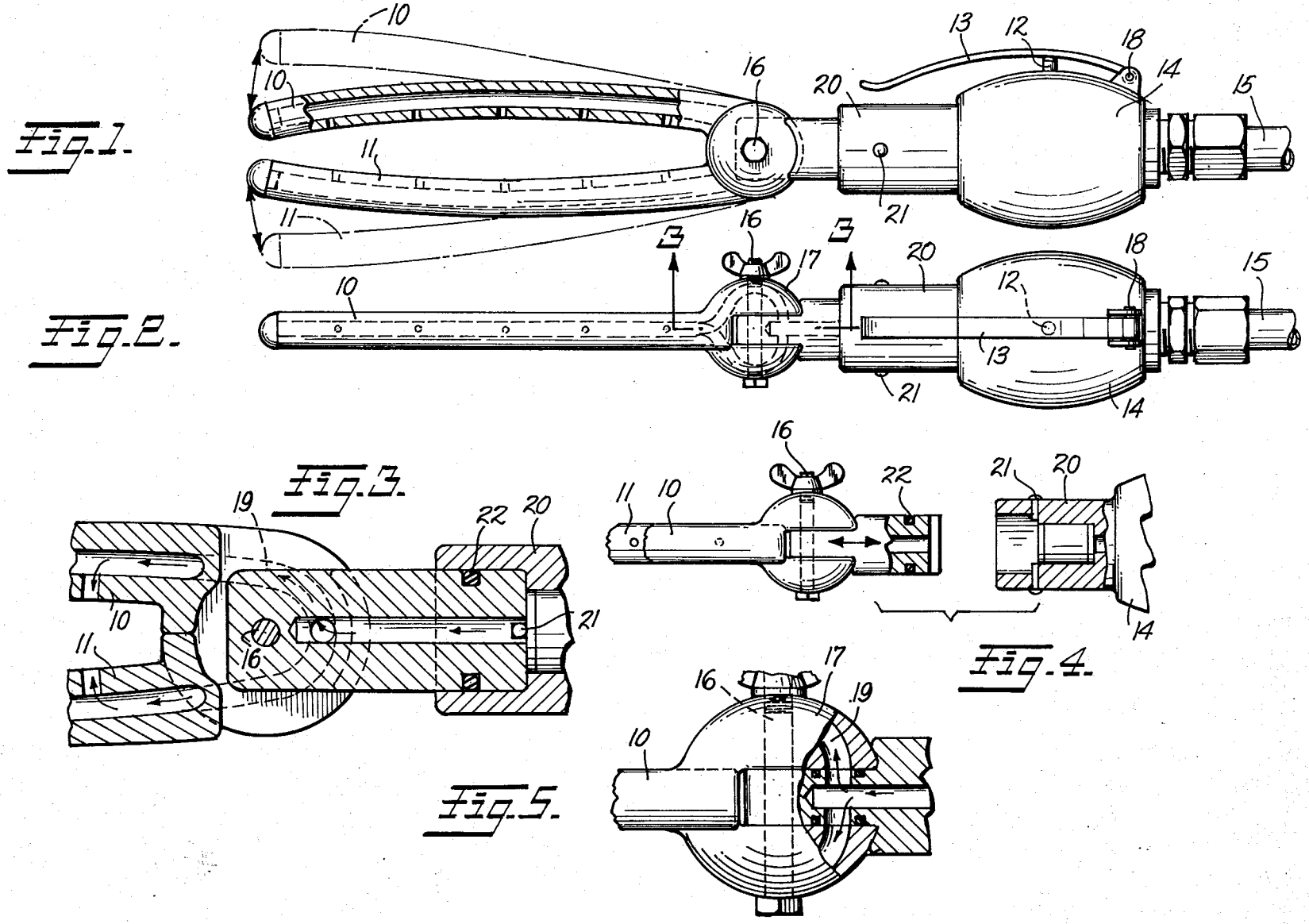
FIG. 1 is a side elevational view, partly in section, of the miniature particle or slide cleaner of the present invention.
FIG. 2 is a plan view of the cleaner of FIG. 1.
FIG. 3 is an enlarged fragmentary vertical sectional view, taken on the line 3—3 of FIG. 2.
FIG. 4 is an exploded fragmentary plan view, partly in section, showing how the air jet jaws are removed from the valve body; and, FIG. 5 is an enlarged fragmentary plan view, partly in section, of the pivotal connection for the cleaner jaws showing in detail the air passages therefor.

The dust cleaning portable device shown in the drawings includes allochirally shaped tubular jaw-like members 10 and 11 so opposed as to yield a concave pattern. This dust cleaning device may be formed from light weight metal such as aluminum or from molded resin. Valve 12 when pressed down by handle 13 will permit air flowing from a compressed air source to flow through pipe 15. On its passage through chamber 14 which contains an ionizing material such as polonium or an electric means of ionization, the air will be ionized to discharge dust particles. This ionizing means may be located before or after the valve as required by the kind of valve that is to be used.

In order to obtain greater adjustability, a lap joint swivel clamping screw 16 is provided so that an adjustment can be made to spread the jaws apart as shown in the phantom line drawing of FIG. 1 to accommodate a thicker object to be cleaned by passage through the wider spaced jaws. The clamping screw passes through chamber 17, and in FIG. 3, said chamber includes passageways 19 so that the air may freely flow to each of the jaws. Furthermore, a mechanical construction such as 3 swivel clamp screws aligned in tandem could be used to permit the jaws to move outwardly from each other and parallel to each other. Though only swivel clamp screw means has been illustrated for moving the jaws apart, it is contemplated that other mechanical means such as tongue and groove or spring means may be used for this purpose.

In the event that a workpiece of longer size is to be cleaned, jaws of a greater length would be required. To provide such jaws of a greater length, there is provided, as shown in FIG. 4, a collar 20 bearing detent pins 21 against o-ring 22 which is locked into position. The pins can be moved outwardly to release a smaller set of jaws and moved inwardly to lock into position a longer set of jaws.

Thus provision is made by this jaw cleaning device to obtain adjustability for cleaning objects that may vary both in length and thickness.

In a typical example for using the described dust cleaning jaws, a slide or film is held in a frame. The operator holds the cleaning jaws by chamber 20, using his thumb for manually controlling the air valve. He then places the fixed frame between said jaws and actuates the flow of jet propelled ionized air on both the upper and lower faces of the frame. Thus, the opposed jets of ionized air blow away all dust particles and at the same time cause static electricity to be discharged whether it is found on the dust particles, the slide or film, or the frame.

The use of these portable tubular jaws enables the operator to carry the cleaning device to a fixed article to be cleaned. In many instances the work to be cleaned is carried on an assembly line and it may be necessary to carry the cleaning device to the fixed-in-place workpiece. It is contemplated to construct the device with light weight metal such as aluminum, or resin.

The air pressure used is generally at least 50 p.s.i. Safety regulations are met because the pressure at each jet is much lower. The jets cannot be directed in a dangerous manner because of their opposing construction.

The use of a concave curvature for the tubular jaws reduces the possibility of contacting or scratching the surfaces of the articles being cleaned.

Although the example given of the object being cleaned is for a slide or film, it is contemplated that other small objects which can be cleaned include glass or plastic lens, transistors, electronic components, and microscopic slides of organic or inorganic materials.

This cleaning device has the advantage of being manufactured at low cost. Despite this, the cleaning jaws are adjustable by opening the jaws to pass over thicker work pieces or replacing shorter jaws with longer jaws to accommodate for longer work pieces. These cleaning jaws may be designed for hand use or, if desired, may be fixed in place while still retaining the features of adjustability and interchangeability. This accommodation makes it possible to clean irregularly shaped objects.

The air ionizing means could be provided by using any radioactive element such as polonium or americium. In addition, A.C. or D.C. electrical means may be employed for this purpose.

Although a manual valve has been described, it is possible to employ an electrical or a pneumatic valve instead.

I claim:

1. A device for cleaning away dust from small flat work pieces comprising two allochirally shaped and adjustable juxtaposed tubular pipe jaws which are shaped concavely with their concave surfaces facing each other wherein each of said surfaces has openings for providing the passage therethrough of opposed air jets, so allocated as to provide equal air flow on opposite sides of said work pieces.

2. The device of claim 1 wherein the openings are about 1/16 inch in diameter for removing dust from photographic film.

3. The device of claim 1 wherein the openings are located along the longitudinal center axis and equidistantly spaced on each of the jaws.

4. The device of claim 1 wherein a gas ionizing means is connected to a compressed air source and in the path of the air jets before they issue from the openings on the jaws.

5. The device of claim 1 wherein the jaw members are composed of metal.

6. The device of claim 1 wherein the jaw members are composed of resin.

7. The device of claim 1 wherein the jaws may be spread apart at one end by providing a suitable hollow swivel joint at the other end.

8. The device of claim 7 wherein the said joint is a hollow swivel lap joint in combination with a clamping screw.

9. The device of claim 1 wherein said jaws are removably mounted in a yoke retaining handle.

10. The device of claim 9 wherein the removable means includes an o-ring which can be snapped into detent notch locations in the handle.

* * * * *